US005669497A

United States Patent [19]

Evans et al.

[11] Patent Number: 5,669,497

[45] Date of Patent: Sep. 23, 1997

[54] BICYCLE PACKAGING FIXTURE ASSEMBLY

[75] Inventors: Marc P. Evans, Reno, Nev.; Peter M. Cazalet, Campbell, Calif.

[73] Assignee: Endurance Sport Technology Group, Inc., Chappaqua, N.Y.

[21] Appl. No.: 597,494

[22] Filed: Feb. 2, 1996

[51] Int. Cl.[6] ..... B65D 85/68

[52] U.S. Cl. ..... 206/335; 224/309; 248/176.1

[58] Field of Search ..... 206/335; 190/18 A; 211/22; 224/309, 321, 324, 924; 248/176.1, 176.3, 188.8; 482/57, 61

[56] References Cited

U.S. PATENT DOCUMENTS

| | | | |
|---|---|---|---|
| D. 343,062 | 1/1994 | Delage et al. . | |
| 2,238,166 | 4/1941 | Gagen | 206/335 |
| 2,299,355 | 10/1942 | Stolpman | 206/335 |
| 2,330,448 | 9/1943 | Reaume | 206/335 |
| 2,339,947 | 1/1944 | Reaume | 206/335 |
| 3,929,225 | 12/1975 | Locke et al. | 206/335 |
| 4,469,224 | 9/1984 | Ritter | 206/335 |
| 4,792,039 | 12/1988 | Dayton | 206/335 |
| 4,991,715 | 2/1991 | Williams | 206/335 |
| 5,520,280 | 5/1996 | Lickton | 206/335 |

*Primary Examiner*—Jimmy G. Foster
*Attorney, Agent, or Firm*—Holland & Hart LLP

[57] ABSTRACT

A bicycle disassembly and shipping apparatus for compactly and securely shipping a bicycle. The bicycle disassembly and shipping apparatus comprises a pair of fork support fixtures to which the front and rear forks of the bicycle frame are attached; fastening straps by which the handlebar, seat and pedals are attached to the frame; a top support fixture which in conjunction with the fork support fixtures provides for the clamping of the bicycle wheels to the frame and to the top support fixture; and a container into which the disassembled bicycle and fixtures are encased for purposes of transport. An automobile roof attachment system comprising a plurality of straps having strap end fixtures for attaching the bicycle packaging fixture assembly to the roof of an automobile is provided.

9 Claims, 13 Drawing Sheets

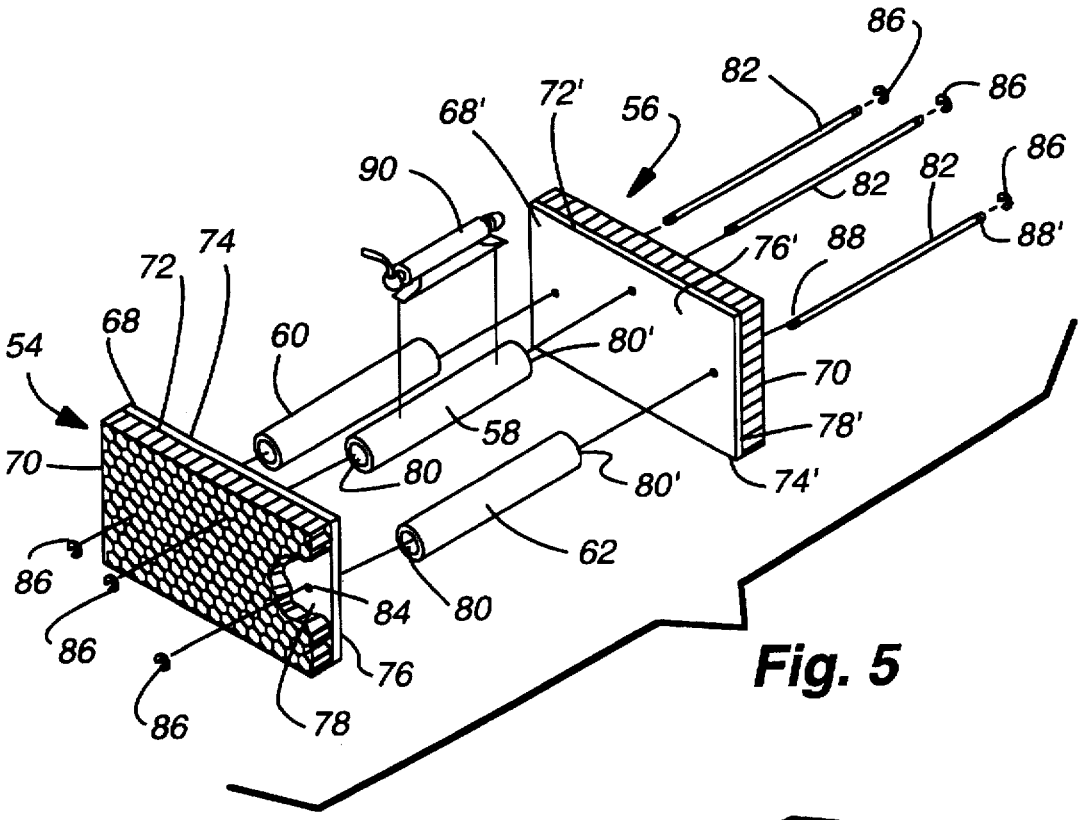
Fig. 5
Fig. 7
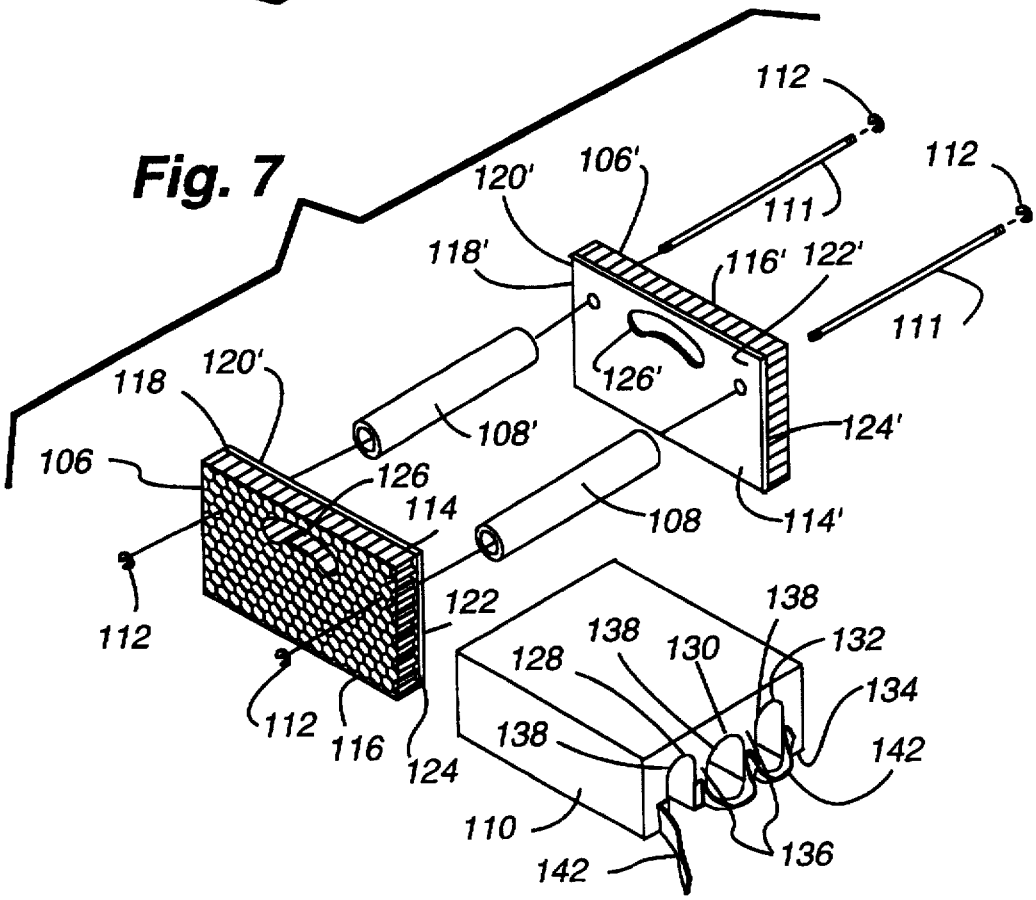

140
138
155
130
132
128
48
100
116'
116
110
40
38
44
90
150
146
34
Y
70
70'
Z
158

BICYCLE PACKAGING FIXTURE ASSEMBLY

BACKGROUND OF THE INVENTION

1. Field of the Invention

This invention relates to a bicycle disassembly and shipping apparatus. More particularly, this invention relates to packaging fixtures for the transport of a bicycle in a box.

2. Description of Related Art

There are millions of bicycles and frame sets sold worldwide annually. These range in cost from less than one hundred dollars to several thousand dollars. Typically a bicycle is shipped from the manufacturer to the distribution center, from the distribution center to the retailer, and then sold to the consumer. After the bicycle is purchased, many people ship their bicycles when they travel.

Each of these instances of shipping provide a possibility of damage to the bicycle. It is estimated that 5% of the bicycles shipped from manufacturer to retailer are damaged in shipment, resulting in millions of dollars of damage costs annually.

The typical shipping container for bicycles is a cardboard box. The container is not impact resistant and cannot be reliably stacked one upon the other without a risk of damage to the contents. The containers are designed to be used once, and are not intended for re-use. However, many people use these containers several times over for transporting their bicycles or frame sets. These cardboard boxes are oftentimes ruined after one, or a few, uses.

Hard shell cases having a cushioned interior are available for transporting bicycles. The hard shell cases provide adequate protection while shipping bicycles, but are extremely expensive, and thus are not an economical option for manufacturers, or for most consumers. Additionally, they are sometimes cumbersome and difficult to transport.

There is missing in the art an affordable and reusable apparatus for transporting a bicycle efficiently and economically while at the same time providing adequate protection.

SUMMARY OF THE INVENTION

It is a primary object of the invention to provide an inexpensive, secure, easy to pack, reusable disassembly and shipping system for bicycles.

It is another object of the invention to provide a stand on which to disassemble a bike to make it easier to pack.

It is another object of the present invention to provide a bicycle packing system designed to work with bicycle manufacturers' existing shipping containers and to reduce the damage that occurs from the use of those containers.

It is another object of the present invention to make a bicycle shipping container that is easy to transport.

It is another object of the present invention to make a bicycle shipping container that can be stacked without damaging the contents of the container.

It is another object of the present invention to provide a bicycle shipping container system for convenient short-term use as a automobile bicycle carrier.

The invention is generally embodied in a bicycle packaging fixture system, which comprises a set of four fixtures which in combination provide for the disassembly, packing, and transport of a bicycle within an inexpensive cardboard container.

The front wheel of the bicycle is removed and the front forks of the bicycle are connected by means of a quick release clamp, of standard design, to a front fork support fixture. The rear wheel is then removed and the rear forks are connected by means of a quick release clamp to a rear fork support fixture. This pair of fixtures in combination provide a secure stand for further disassembly of the bicycle.

With the frame thus secured, the various frame components may be disassembled for shipment. The frame components include, but are not limited to, the seat, handlebar, and pedals. These can be strapped to the frame using velcro fasteners.

The front and rear wheels are then positioned on opposite sides of the frame in contact with respectively the front and rear fork fixtures. The front and rear wheels are releasably attached to their respective fork fixtures by Velcro® straps. In order to affix the front and rear wheels, with the bicycle frame, into a rigid assembly, a top support fixture is affixed to a top-tube of the bicycle frame with velcro fasteners. Additional velcro fasteners are utilized to strap the front and rear wheels to the top support fixture. The wheels are thus firmly anchored to the top support fixture on either side of the bicycle frame, and the forks and the wheels are firmly attached to their respective fork fixtures to form a unified and rigid assemblage. The whole assembly is then ready for packing in a shipping container.

The fixtures are sized such that the bike and support fixture assembly can be lowered into a cardboard transport box to fit snugly therein. The support fixtures distance the bike from the shell of the cardboard container and absorb most impacts that strike the container at the location of the fixtures. Additionally, the support fixtures strengthen the cardboard container by allowing multiple containers to be stacked without damage to the contents of the containers.

The fourth fixture of the transport arrangement includes a pair of wheels which are positioned beneath the cardboard container to facilitate the rolling transport of that container along a support surface. These wheels are removably attached to the container and positioned beneath either one or both of the front or rear fork support fixtures.

Unpacking the reusable container proceeds in the reverse manner from the packing. The shipping assembly comprising the fixtures, frame, frame components, and wheels, is lifted as one piece from the shipping container. This assemblage is placed on the floor resting on the front and rear fork support fixtures. The top support fixture is then removed. The components that were strapped to the frame are then reassembled. This assembly includes the seat, handlebar and pedals. The wheels and forks are removed from their respective fork support structure so that the wheels and forks can be recombined.

The three fixtures are then placed back in the shipping container to be used at a later time. The wheels can also be removed from the bottom of the container and placed inside of the container.

An automobile roof attachment system is provided to allow the bicycle packaging fixture assembly to be used in transporting the bicycle on a vehicle. The roof attachment system comprises as series of straps for engaging the fixture assembly and attaching to the automobile in order to secure the fixture assembly in place.

Other aspects, features and details of the present invention can be more completely understood by reference to the following detailed description of a preferred embodiment taken in conjunction with the drawings and from the appended claims.

BRIEF DESCRIPTION OF THE DRAWINGS

FIG. 5 is an exploded view of a front fork support fixture as shown in FIG. 3.

FIG. 7 is an exploded view of a top support fixture utilized in the present invention.

DESCRIPTION OF THE PREFERRED EMBODIMENT

The examples of the invention provided herein pertain to the use of the present invention for the support of a bicycle frame in a first embodiment, and for the packaging and transport of that frame and the related bicycle components in a second embodiment.

Figure 1:
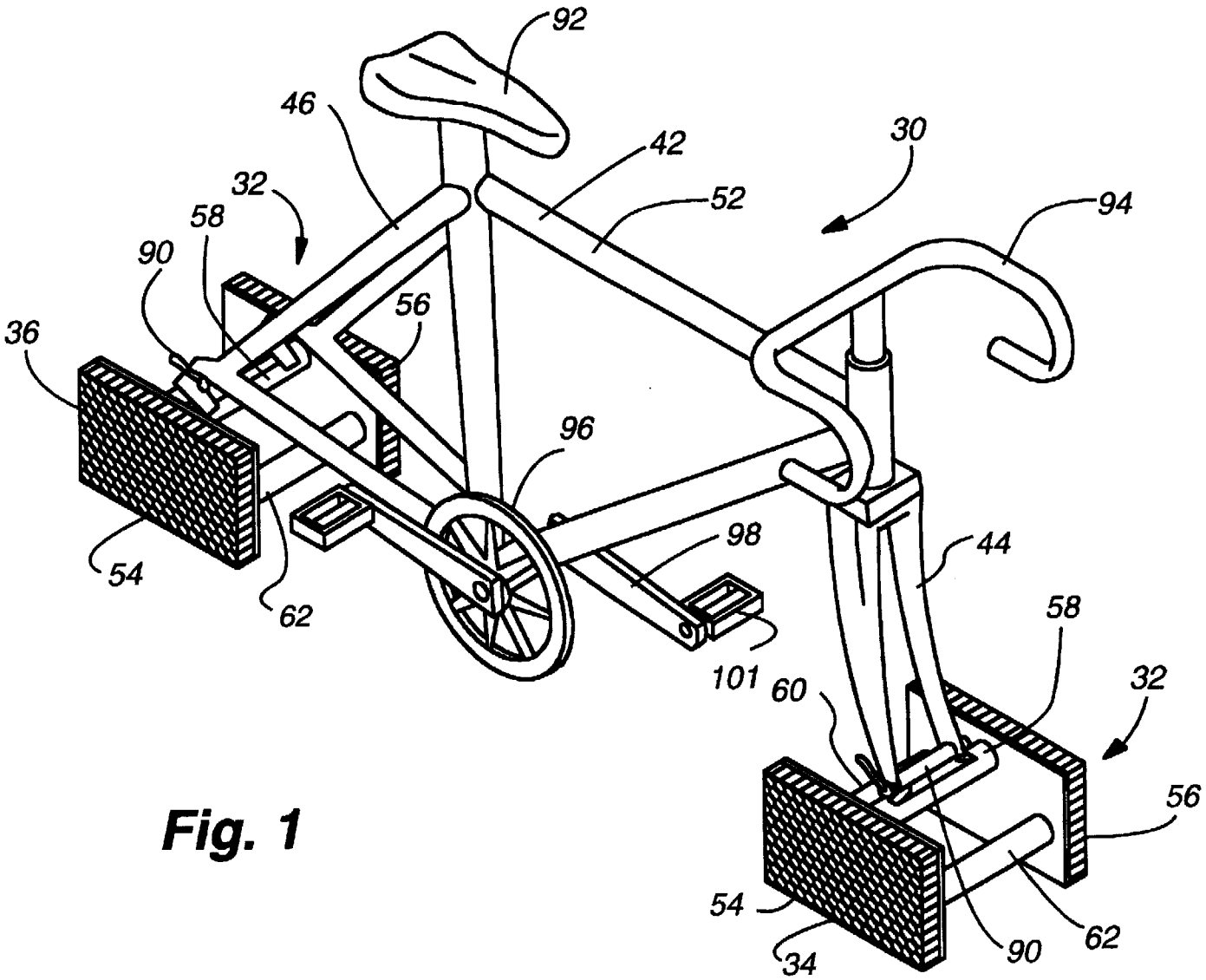
FIG. 1 is a perspective view of a bicycle support base, incorporating a first embodiment of the present invention, supporting a bicycle frame.

In a first embodiment, a disassembled bicycle 30 supported on a base 32 incorporating the present invention is shown in FIG. 1. Base 32 comprises a front fork support fixture 34 and a rear fork support fixture 36. The front forks 44 of the bicycle frame 42 are secured to the front fork support fixture 34, and the rear forks 46 of the bicycle frame 42 are secured to the rear fork support fixture 36. In this first embodiment, the front 34 and rear 36 fork support fixtures form the base 32 for sturdily supporting the frame 42 for further work on the bicycle 30.

Figure 2:
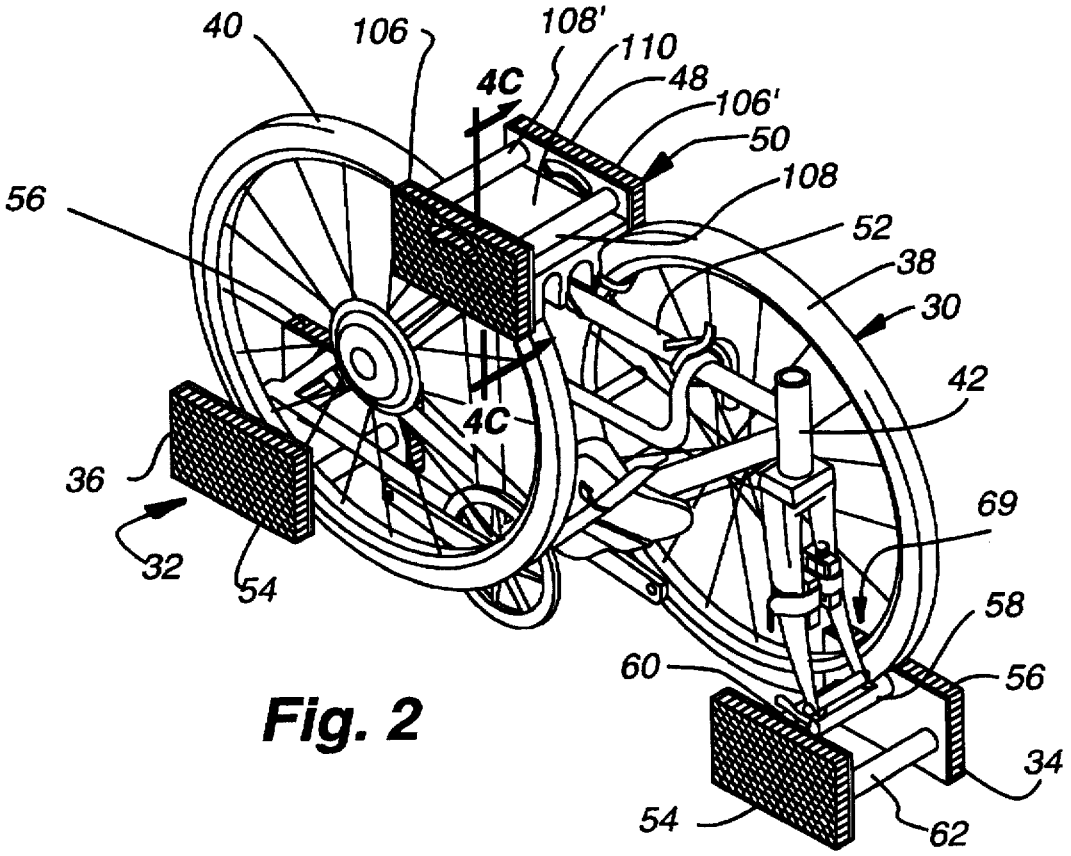
FIG. 2 is a perspective view of a bicycle packaging fixture assembly incorporating a second embodiment of the present invention.

In a second embodiment, the fixtures 34 and 36, in addition to a top support fixture 48, are used as part of a bicycle packaging fixture assembly 50, as shown in FIG. 2. One of the wheels 38 is positioned on a desired side of the frame 42 and engages the front fork support fixture 34, while the other wheel 40 is positioned on the opposite side of the frame 42 and engages the rear fork support fixture 36. Each wheel is releasably attached to its respective support fixture 34 or 36. The various bicycle components are attached to the frame 42.

The top of the wheels 38 and 40 are held in position next to the top-tube 52 of the frame 42 by the top support fixture 48 which, releasably receives both of the wheels 38 and 40, and the top-tube 52. The top support fixture 48 in combination with the front 34 and rear 36 fork support fixtures act to hold the wheels 38 and 40, and the frame 42 firmly together to allow a user to lift the assemblage as a unit for placement into a container (See FIG. 6).

The current invention facilitates disassembly of the bicycle 30, and is utilized in packaging and transporting the bicycle. The front 34 and rear 36 fork support fixtures by themselves provide a stable base 32 for supporting the frame 42, see FIG. 1 and 4, and in combination with the top support fixture 48, create a unifying structure for the bicycle frame 42 and all of its various components, see FIG. 2. The assemblage is compact and rugged, it is easily packed in a standard cardboard shipping container, and the fixtures strengthen the container and allow several containers to be stacked without damage to the contents.

Figure 3:
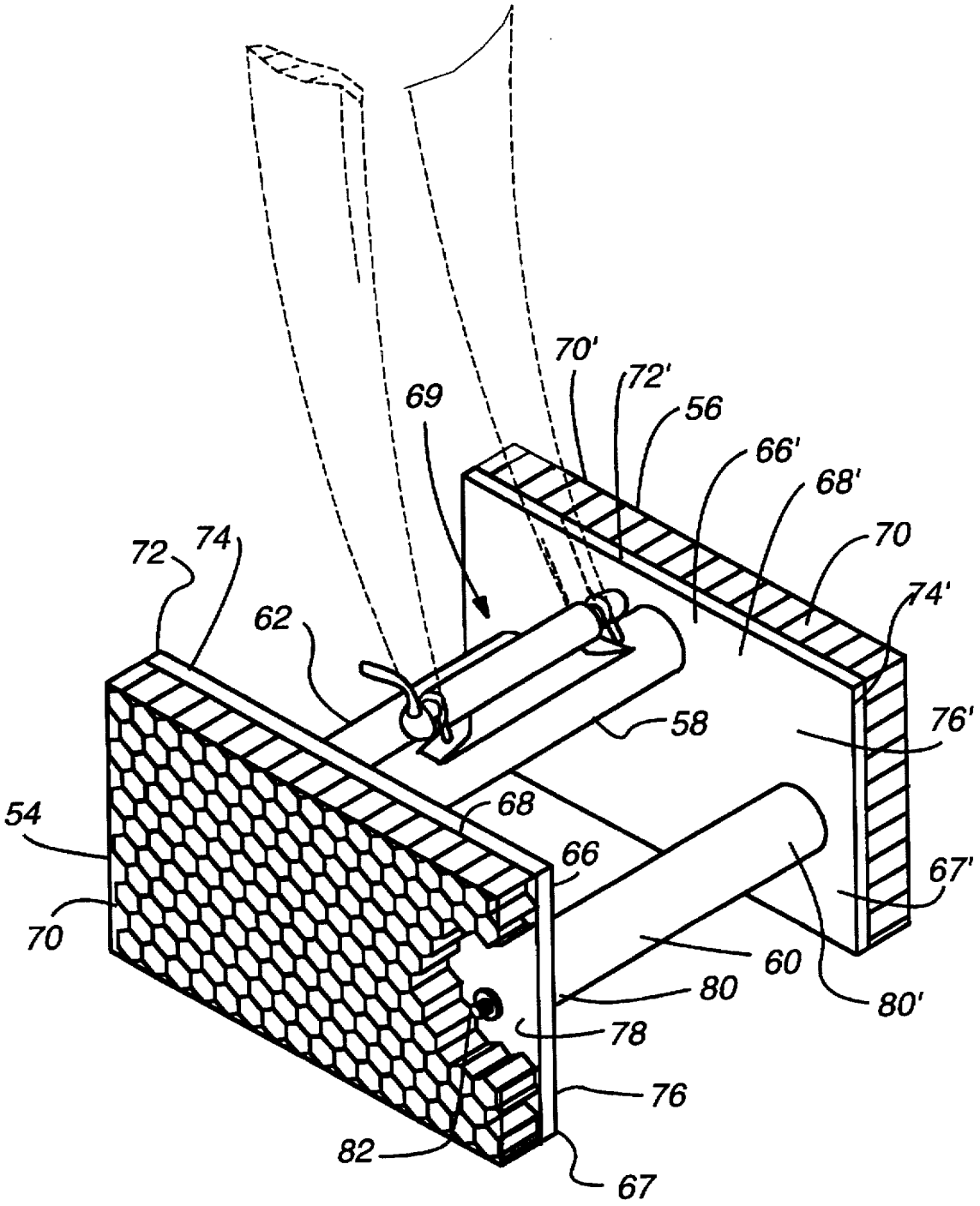
FIG. 3 is an enlarged perspective view of a front fork support fixture.

Referring to FIGS. 1, 3, 4, and 5, the front 34 and rear 36 fork support fixtures are identically constructed, and comprise two planar end energy absorbing members 54 and 56 spaced apart in a parallel orientation by three elongated and rigid tubular cross members 58, 60 and 62. The planar end members 54 and 56 are affixed to the tubes 58, 60 and 62, as described in more detail below. Referring to FIG. 3, the tubular cross members are positioned parallel to one another between the planar end members 54 and 56 to form a triangular orientation of the longitudinal axes of the cross members. When engaging a support surface 64 (see FIG. 4) in the upright position, the upper tubular cross member 58 is affixed between the upper portions 66, 66' of the planar end members 54 and 56, and forms the apex of the triangular orientation, and the other two tubular cross members 60 and 62 are affixed between the lower portions 67, 67' of the planar end members 54 and 56, forming the base of the triangular orientation. The triangular orientation of the tubular cross members 58, 60 and 62, between the planar end members 54 and 56 provides adequate strength in compression, as well as adequate torsional stiffness.

A wheel seat 69, as shown in FIG. 2 and 3, is formed between the upper tubular cross member 58 and either of the lower tubular cross members 60 or 62. The cross members can be constructed of metal or high-impact plastics.

Referring to FIGS. 3 and 5, preferably, each planar end member 54 and 56 comprise an inner metal or high-impact plastic endplate 68, 68' and an outer side cushion structure 70, 70'. The endplates 68, 68' each have a perimeter 72, 72' defining an edge 74, 74' an inner surface 76, 76' adjacent to the cross members, and an outer surface 78, 78' to which are fastened the side cushion structures 70, 70'. The side cushion structures 70, 70' are affixed to the outer surfaces 78, 78' of the endplates 68, 68' by any common adhesive, preferably a type that would allow the cushion structures 70, 70' to be removed.

The side cushion structures 70, 70' are of generally similar profile to the end plates 68, 68' and preferably have a cross-sectional honeycomb structure which, as will be discussed later, facilitates the packaging and protection aspect of the current invention. The side cushion structures 70, 70' are deformable to absorb impact, and can be removed and replaced if necessary.

Each tubular cross member 58, 60 and 62, defines opposing ends 80, 80' which are rigidly affixed to the end plates 68, 68' in any known manner. The end plates 68, 68' are generally planar and are disposed at right angles to the longitudinal axes of the tubular cross members 58, 60, and 62. The tubular cross members are rigidly affixed to endplates 68, 68' in a manner well-known to those skilled in the art, which may include gluing, welding, threading, bolting or clipping. In a preferred fastening means, shown in FIGS. 3 and 5, a pin 82 extends axially through each cross member 58, 60 and 62 and outwardly from the opposing ends 80, 80'. The pin 82 extends through an aperture 84 formed in the endplate. The endplate 68 is fixedly secured to the cross member 58, 60 and 62 by a compression clip 86 which releasably engages both ends 88, 88' of the pin 82 circumferentially at the appropriate position on the pin to hold the endplates 68, 68' securely to the ends 88, 88' of the cross members 58, 60, and 62.

As shown in FIG. 1, 3 and 5, a clamping device 90, such as a quick-release type fastener commonly used to secure the front 44 and rear forks 46 of bicycle frames to racks or other types of storage units, is mounted on the upper cross member 58 to receive the forks of the bicycle frame 42. The quick release mounted on the rear fork support fixture 36 may be wider than the one mounted on the front fork support fixture 34 to accommodate the difference between front 44 and rear 46 fork structures.

Figure 4:
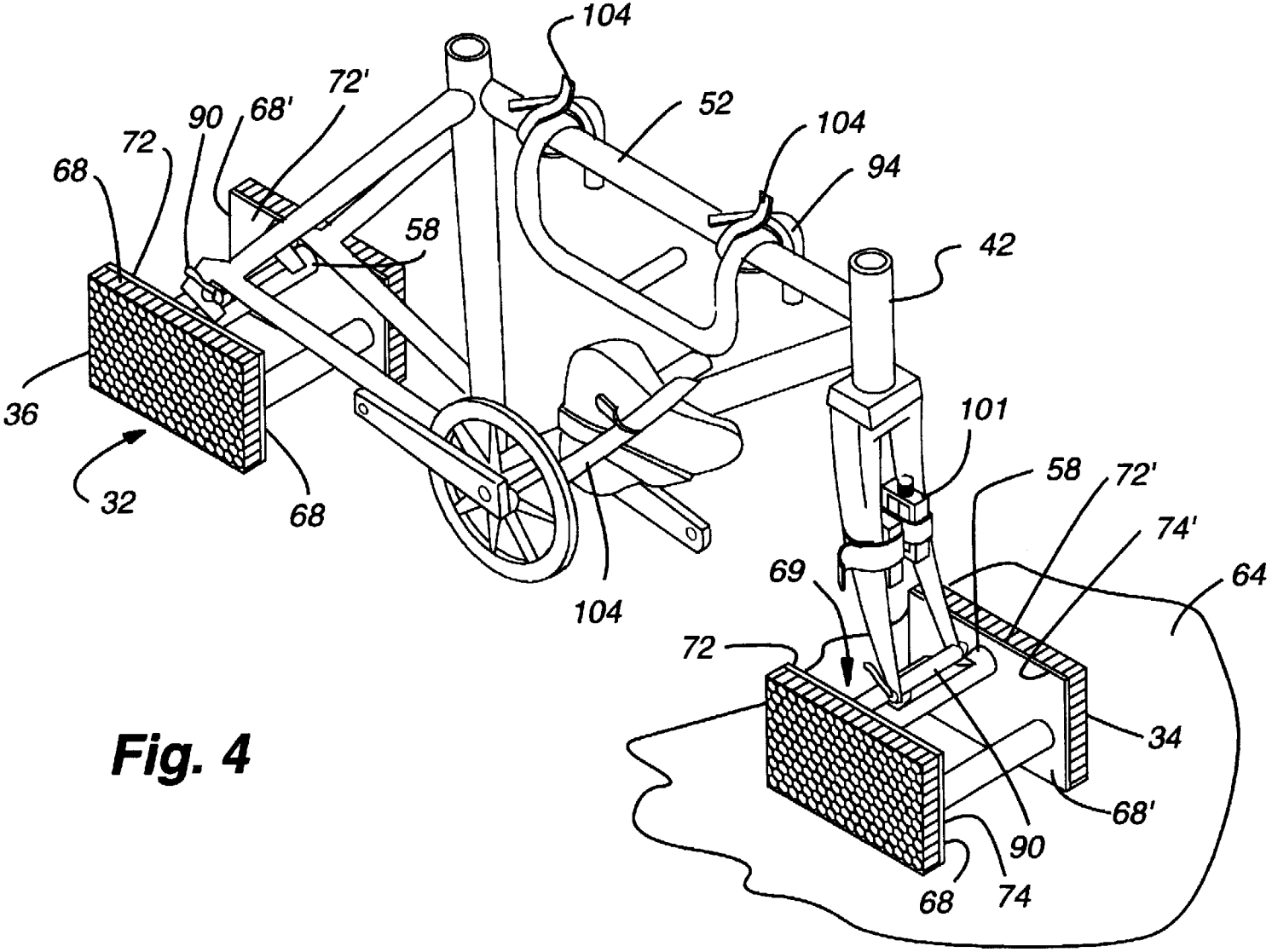
FIG. 4 is a perspective view of the bicycle support as shown in FIG. 1, illustrating the attachment of frame components to the frame.

As shown in FIGS. 1 and 4, the front 34 and rear 36 fork support fixtures provide a stable base 32 on which to position a bicycle frame 42 for repair and/or further disassembly preparatory to packaging. In reference to FIG. 4, a bicycle frame 42, having a typical structure and including front 44 and rear forks 46, is shown rigidly affixed to a front fork support fixture 34 and a rear fork support fixture 36, which support fixtures provide a stable platform as above discussed for working on and/or further disassembly of the bicycle frame 42.

The front forks 44 are securely attached to the front fork support fixture 34 by the quick-release clamping device 90 mounted on the upper cross member 58, and the rear forks 46 are securely attached to the rear fork support fixture 36 by the quick release clamping device 90 mounted on the upper cross member 58 of the rear fork support fixture 36. The endplates 68, 68' are spaced apart by the cross members 58, 60 and 62 a sufficient distance, approximately 5 inches, to provide a sturdy platform to support the frame 42 in this use. The endplates are sufficiently rigid to support the frame 42 upon the support surface 64 along the edge 74, 74' defined by the perimeter 72, 72' of each endplate 68, 68'.

In further reference to the bicycle frame 42 itself as shown in FIG. 1, it will be noted that the seat 92 is rotatably and slidably affixed to the upper rear portion of frame 42, and that handlebar 94 is rotatably affixed to the upper front portion of frame 42 and disposed in a manner well-known in the art so as to impart rotational movement to the front forks 44. In the lower central portion of the frame, sprocket 96 has affixed to it opposing crank arms 98. Pedals 100 are each affixed to the extreme end of the crank arms.

Figure 6:
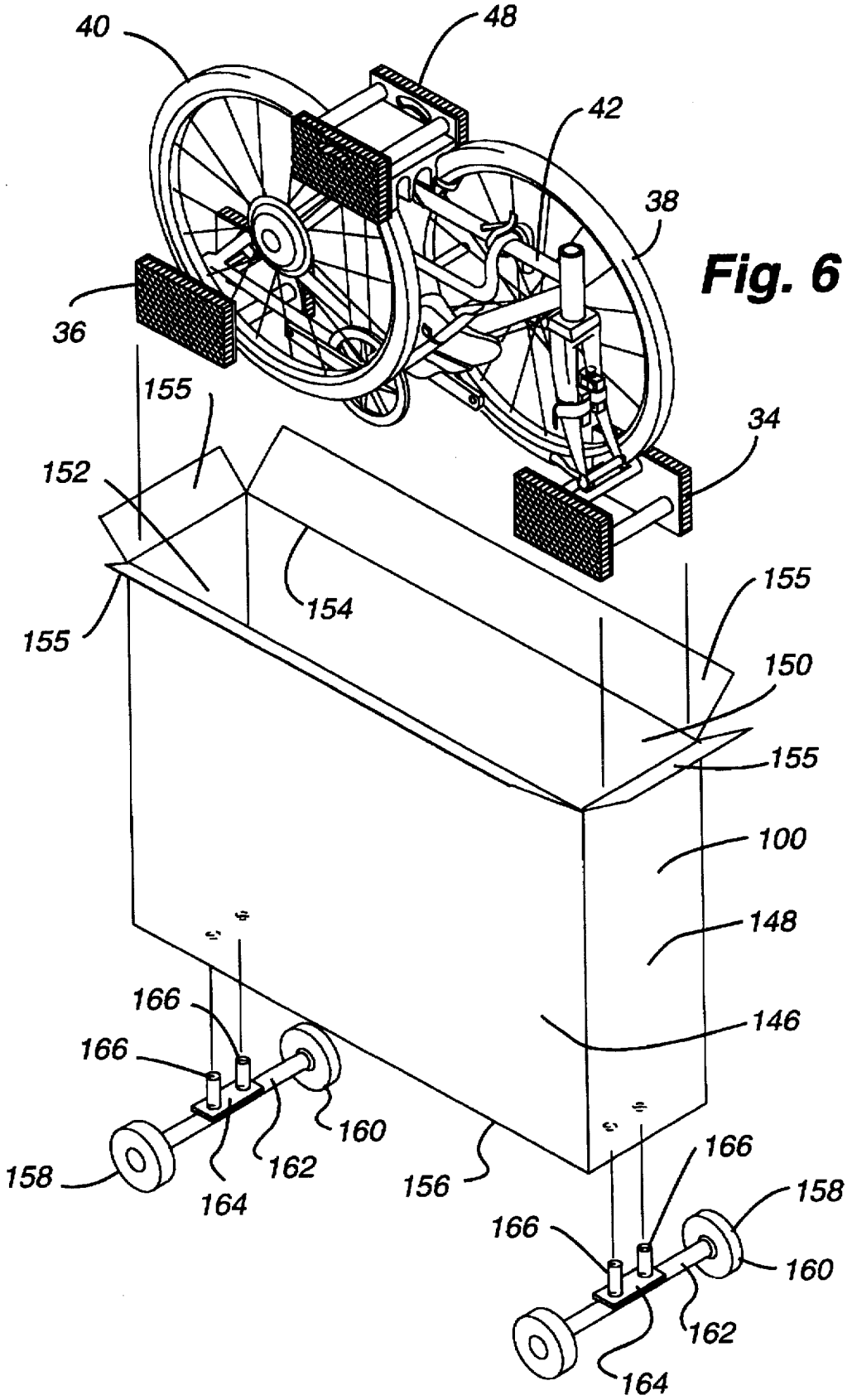
FIG. 6 is an exploded view of the bicycle packaging fixture assembly in use with a container, illustrating the disassembled bicycle, the container, and wheel assemblies.

In the second embodiment as a packaging fixture assembly 50, the front 34 and rear 36 fork support fixtures are used in conjunction with the top support fixture 48 to hold the frame 42 and the wheels 38, 40 as a unitary assemblage for securely and safely packing the bicycle in a container 100 (See FIG. 6).

In preparation of the bicycle frame 42 for utilization in this second embodiment, FIG. 4 shows various removable portions of frame 42 displaced from their normal positions on the frame in preparation for packaging the bicycle for transport. The handlebar 94 has been removed from the front portion of the frame 42 and can be draped over the upper cross member 52 of the frame 42 and affixed in that position to the frame by velcro fastening straps 104 providing a more compact arrangement for shipping. The handlebar could also be placed elsewhere depending on the specific shape of the handlebar, such as suspended between the top bar and the front forks.

Also, seat 92 has been removed from the upper portion of frame 42 and has been fastened in the mid-portion of frame via velcro fastening straps 104. The seat could also be put elsewhere depending on the structure of the particular frame, such as upon the rear forks 46. Finally, pedals 101 have been removed from cranks 98 and have been affixed between the front forks 44 by means of velcro straps 104. With the frame 42 thus disassembled, only the remaining portions of the bicycle 30, specifically the wheels 38 and 40, need to be securely attached to the frame prior to shipment.

Alternatively, the seat, peddles, and handlebars could each be placed in gear bag (not shown) and positioned in the container 100 apart from the fixture assembly.

Figure 8C:
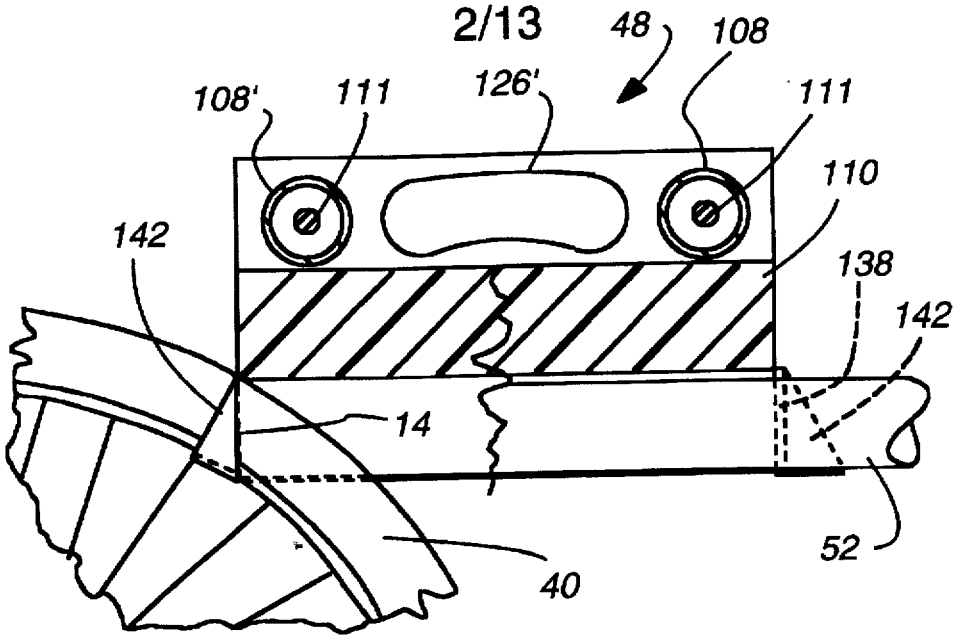
FIG. 8C is a section view take along the lines 8C—8C in FIG. 8A.
Figure 8A:
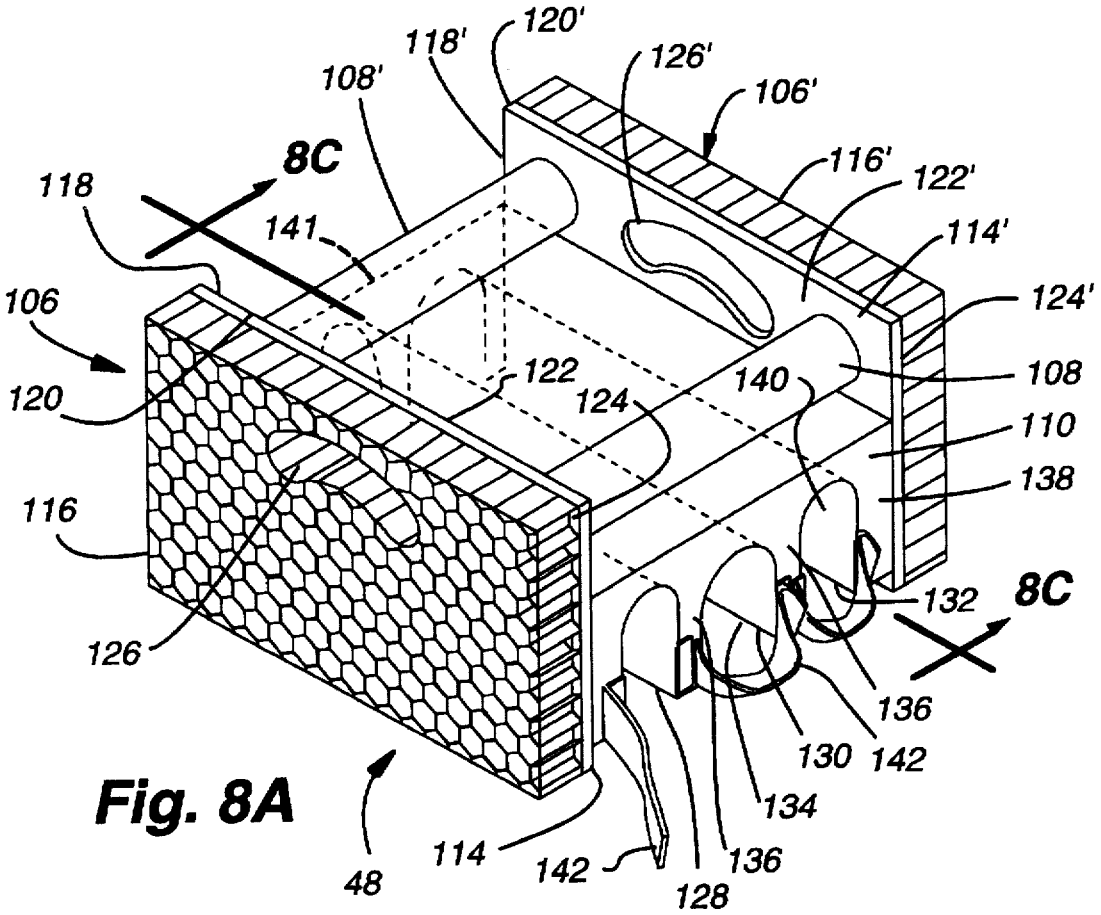
FIG. 8A is a perspective view of the top support fixture utilized in the present invention.
Figure 8B:
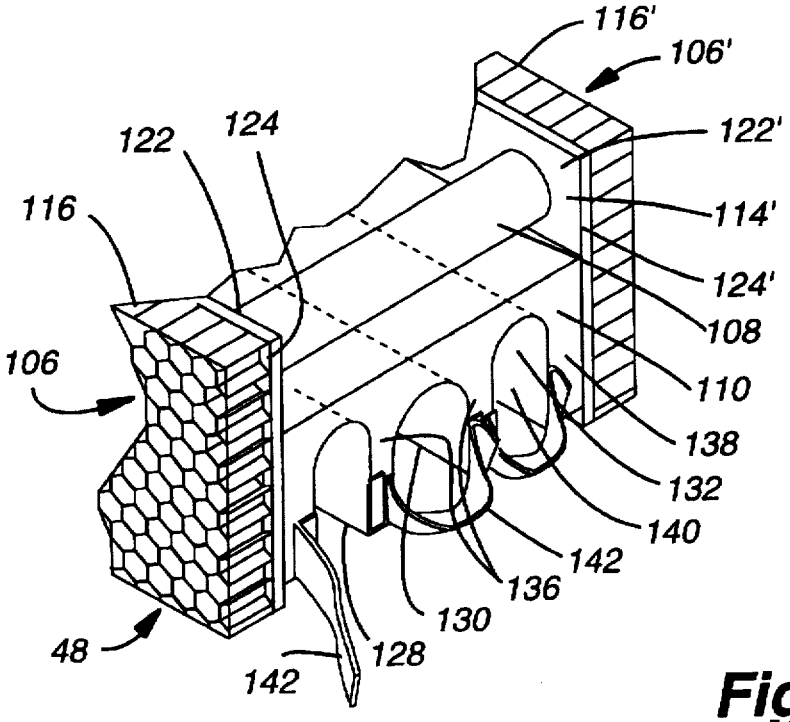
FIG. 8B is a partial view of the top support fixture shown in FIG. 8A.

By reference to FIGS. 2, 7, and 8A, the remaining fixture for accomplishing this objective is shown. The top support fixture 48 comprises two planar end energy absorbing members 106, 106' spaced apart in a parallel orientation by two elongated and rigid tubular cross members 108, 108' and a wheel guide 110. The planar end members 106, 106' are affixed to the cross members 108, 108' by pins 111 and compression clips 112, as described above with reference to the fork support fixtures 34 and 36. The tubular cross members 108, 108' are positioned parallel to one another between the upper portions of the planar end members 106, 106'. The wheel guide 110 is positioned below the cross members 108, 108' and sandwiched between planar end members 106, 106'. The planar end members 106, 106' are positioned parallel to one another and orthogonal to the cross members 108, 108'.

In a preferred embodiment, and in reference to FIGS. 7 and 8A, the planar end members 106, 106' of the top support fixture 48 each comprise an inner metal or high-impact plastic endplate 114, 114', and an outer side cushion structure 116, 116'. The endplates 114, 114' each have a perimeter 118, 118' defining an edge 120, 120', an inner surface 122, 122' adjacent to the cross members 108, 108', and an outer surface 124, 124' to which are fastened the side cushion structures 116, 116'. The side cushion structures 116, 116' are affixed to the outer surfaces 124, 124' of the endplates 114, 114' by any common adhesive, preferably a type that would allow the cushion structures 116, 116' to be removed.

The side cushion structures 116, 116' are of generally similar profile to the end plates 114, 114', and preferably have a cross-sectional honeycomb structure which, as will be discussed later, facilitates the packaging and protection aspect of the current invention. The side cushion structures 116, 116' are deformable to absorb impact, and can be removed and replaced if necessary.

Each planar end member 106, 106' on the top fixture 48 defines an arcuate aperture 126, 126' through both the endplate 114, 114' and the side cushion structure 116, 116'. The handle aperture 126, 126' is formed in the top portion of the planar end members 106, 106' between the two cross members 108, 108'.

The wheel guide 110 is preferably made of a structural foam, such as Ethafoam, or a plastic, and has three downwardly facing grooves 128, 130, and 132, defined in the lower surface 134 thereof, the grooves being delineated from one another by extensions 136. Each groove 128, 130, and 132 has a base portion 138 and opposing downwardly extending sidewalls 140, the sidewalls being formed by the extensions 136 adjacent to the particular groove. The three grooves 128, 130, and 132 have axes parallel one to another and parallel in turn to the end plates 114, 114', and are evenly spaced therebetween. The center groove 130 is wider than the two side grooves. The grooves 128, 130, and 132 run the full length of the lower surface 134 of the wheel guide 110.

Both ends 138, 141 of each groove 128, 130, and 132 have an associated retention member 142 (only those on end 138 are shown), such as a Velcro strap, attached to one adjacent extension 136 and releasably attachable to the opposite adjacent extension for use as described below.

The top fixture 110 is used to secure wheels 38 and 40 to the frame 42 in the assemblage unit for convenient transport, as shown in FIGS. 2, 6 and 8C. The top fixture 48 is positioned on the top-tube 52 of the bicycle frame 42 so that the top-tube is received in the center groove 130 of the top fixture 48. The retention member 142 at either end of the center groove 130 is wrapped around underneath the top-tube 52 of the frame 42 and attached to the top fixture 48 to secure the top fixture 48 to the frame 42. Preferably, the Velcro® strap 142 is extended below the top-tube 52 to the opposing extension 136 and releasably secured thereto. The top fixture 48 is thus secured to the top-tube 52 at either end 138, 140 of the wheel guide 110.

The wheels 38, 40 are added to the assemblage and held in place by the combination of fixtures 34, 36, and 48 by positioning one wheel on either side of the frame 42. One wheel rests on the front fork support fixture 34 and the top fixture 48, and the other wheel rests on the rear fork support fixture 36 and the top fixture 48, respectively.

In more detail, either wheel 38 or 40 is positioned to engage the wheel seat 69 in the front fork support fixture 34, formed by the top cross member 58 and the more rearward of the lower cross-members 60 of the front fork support fixture 34, and at the same time be positioned in the appropriate side groove 128 or 132 on the top fixture 48, depending on which side of the frame 42 the wheel is located. The wheel is releasably held in place on the front fork support fixture 34 by a fastening member 144, such as a Velcro® tie (see FIG. 9) wrapped around the wheel and the cross members 58 and 60, or 58 and 62.

The wheel 38 and 40 are releasably held in place on the top fixture 48 by the retention member 142 at the appropriate end of the side groove 128 or 132. The retention member 142 is wrapped around underneath the wheel and attached to the top fixture 48 to secure the wheel to the top fixture 48. Preferably, the Velcro® strap 142 is extended below the wheel to the opposite adjacent extension 136 and releasably secured thereto. The wheel is thus secured to the top fixture 48.

The second wheel is similarly placed in engagement with the wheel seat 69 of the rear fork support fixture 36. The wheel seat 69 in the rear fork support fixture 36 is defined by the top cross member 58 and the forwardly positioned lower cross member 62 of the rear fork support fixture 36. The wheel is releasably affixed thereto by a fastening member 144, such as a Velcro® tie, as shown in FIG. 9.

Figure 9:
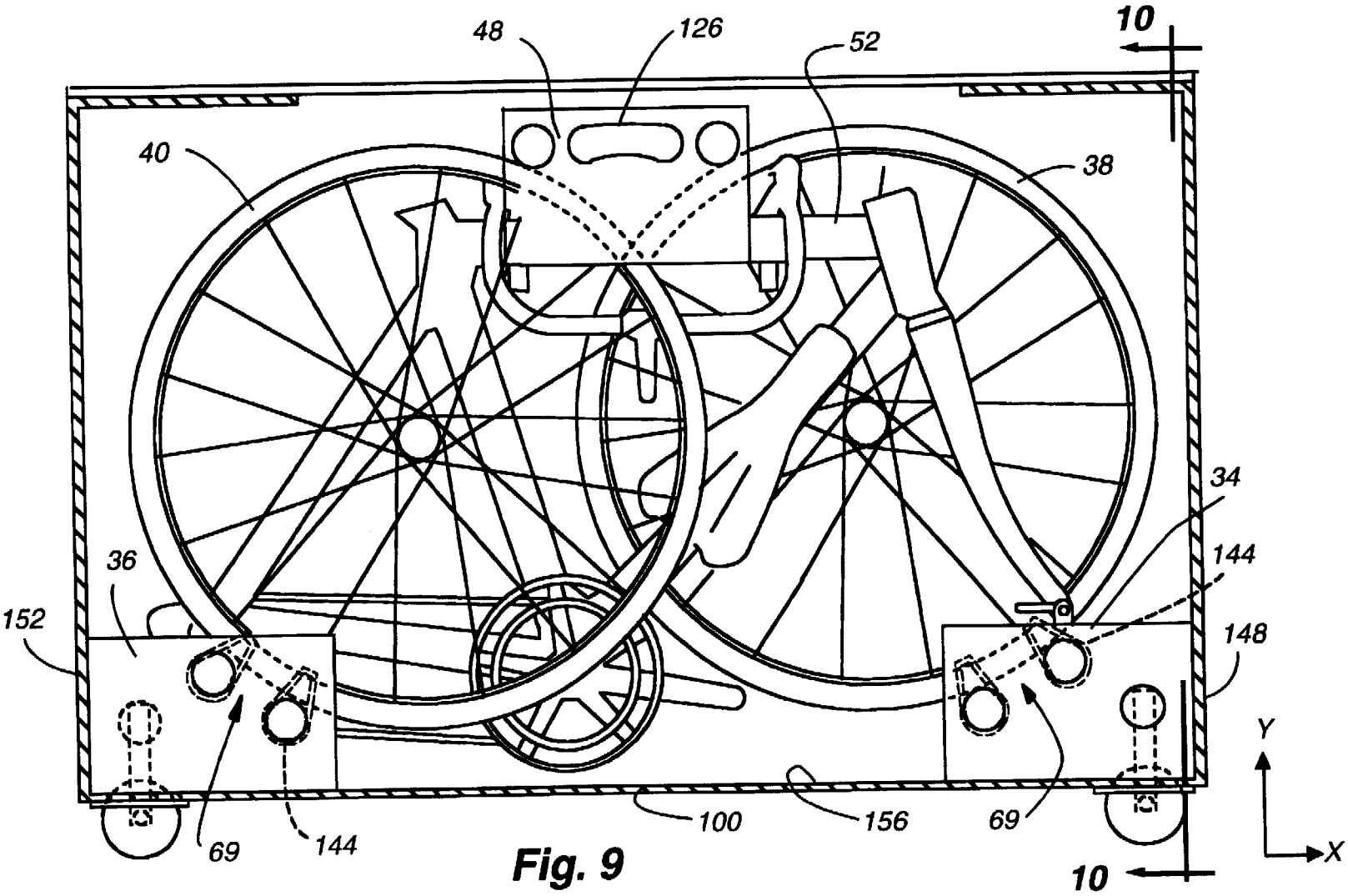
FIG. 9 is a representational schematic view of the package fixture assembly positioned within a container.
Figure 10:
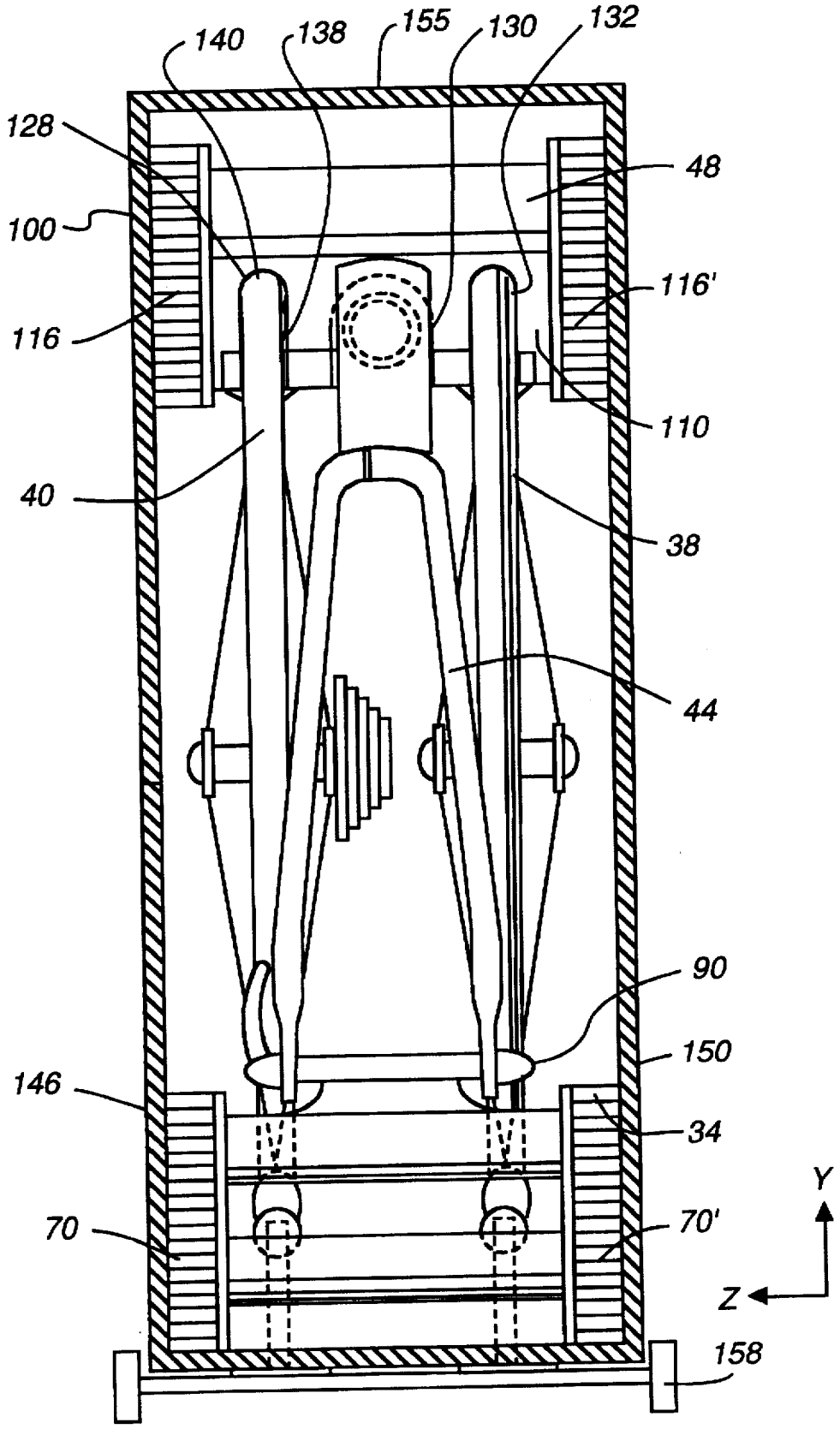
FIG. 10 is a section view taken along line 10—10 of FIG. 9.

Referring to FIG. 10, the wheels 38 and 40, when received in the grooves 128, 132 in the wheel guide 110 and engaging the cross members 58, 60, and 62 of the lower front 34 or rear fork 36 support fixtures, are sturdily positioned in the assemblage. The wheels are restricted from moving laterally by the walls 138 and base 140 of the respective groove of the top fixture 48, and by the fastener strap 144 (see FIG. 9) on the fork support fixture 34 or 36 on which it rests. The wheels cannot move in a vertical motion because they are securely held between the top support fixture 48 and the fork support fixtures 34 and 36, which are in turn securely fastened directly to the bicycle frame 42.

The front 34 and rear 36 fork support fixtures are preferably identical, so that either one can be used in either the front or rear position. The top support fixture 48 can be reversed on the top-tube 52 also.

Now by reference to FIGS. 6, 9 and 10, the utility of the top support fixture 48 is shown. The disassembled bicycle frame 42, components, front wheel 38, and rear wheel 40, are rigidly affixed to the front 34 and rear 36 fork support fixtures and the top support fixture 48. This compact assembly is ready for placement in a shipping container 100. As is clearly shown, front wheel 38 rests on its lower portion against tubular cross members 58, 60 of front fixture 34 and is attached there by fastener 144, and on its upper portion is affixed within groove 132 of wheel guide 110 via velcro strap 142. The rear wheel 40 is supported on its lower portion by the tubular cross members 58 and 62 of rear fixture 36 and is attached there by fastener 144, and on its upper portion as placed within and strapped into groove 128. To complete the assembly, the top tube 52 of the bicycle frame is affixed within groove 130 of wheel guide 110 by means of velcro strap 142 (see FIG. 8C). The top support fixture is preferably positioned over the center of mass (adjusted by sliding the top support fixture 48 along the top-tube 52 prior to fastening) of the assemblage to allow a balanced, and thus an easier to lift assembly. With the bicycle 30 and its various components thus disassembled into a compact form, the bicycle 30 is ready for placement in a shipping container.

FIG. 6 shows the disassembled components being loaded into shipping container 100. The four sides 146, 148, 150, and 152 of shipping container 100 define at their uppermost portion an opening 154 through which the shipping assembly is lowered via either or both of handles. The opening 154 in the container 100 is dimensioned so as to be wide enough to receive the front 34 and rear 36 fork support fixtures, as well as the top fixture 48. Once lowered completely into container 100, flaps 155 close over the opening. The flaps 155 are affixed in a conventional manner to the upper portion of container sides 148, 150, 152 and 154. The lower ends of the container sides are connected by a floor member 156. The shipping container 100 can be of conventional shape and size used in the industry, having a length of approximately 53 inches, a height of approximately 30 inches, and a depth of approximately 8 inches, and being made of cardboard.

In FIG. 9, the relative positioning of the assemblage in the container 100 is shown. Front fork support fixture 34 is shown in contact with floor 156 and end wall 148. Rears fork support fixture 36 is shown in contact with floor 156 and end wall 152. Movement of the bicycle 30 and its components is thus prohibited or restricted in the X and Y directions, as defined by the coordinate in FIG. 9. The upper support fixture 48 is shown adjacent to the upper portion of container 100.

FIG. 10 discloses the restriction of the assemblage in a separate view, with an identical coordinate system as in FIG.

9. The front fork support fixture 34, and specifically the honeycomb side cushion portions 70, 70', are shown in contact with the sides 146, 150 of the container 100. The rear fork fixture 36 (not shown) is identically positioned in engagement with the walls also. The honeycomb side cushion portions 116, 116' of upper wheel support fixture 48 are shown in contact with the sides 146, 150 of the container. The fixtures 34, 36 are thus held securely between the walls of the container 100.

The combined action of upper 48 and lower fixtures 34, 36 prevents transverse movement of the bicycle 30 in the carton 100 and also has the additional benefit due to the combined strength of upper 48 and lower fixtures 34, 36 of resisting lateral compressive forces on the carton, thereby allowing multiple cartons 100 to be stacked one on top of the other.

Preferably, the cushion members 70, 70', 116, 116' have substantial structural strength so as to hold the assemblage sturdily in the container 100, while at the same time are able to deform under impact to protect the contents. The fact that the energy absorbing cushion members of each of the three fixtures 34, 36, 48 is in contact with the walls of the container 100 keeps the assemblage snugly positioned in the container to avoid jostling. The cushion members 70, 70', 116, 116' also protect the assemblage from direct impact. The honeycomb structure permanently deforms under the force of an impact to the fixture, such as the container being dropped on the support surface 64, thus protecting the assemblage from a direct blow. Once the side cushion members have been deformed to an extent where they are no longer useful, they can be removed and replaced. Also, if the container becomes ruined, the fixtures 34, 36 and 48 can be used in a different container. The bicycle packaging fixture assembly can accommodate many different sizes and geometries of frames, or entire bicycles, desired to be transported, including racing styles with smaller wheels, mountain bikes with larger wheels, or most combinations thereof.

The fixtures can be adjusted size to fit various container sizes by either increasing the thickness of the cushioning side members, or by lengthening the cross members positioned between the planar end members.

FIGS. 6, 9, 10, 11 and 12 show the configuration and attachment of a wheel assembly 158 to either the front 34 or rear 36 fork support fixture. It is desirable to transport the shipping container 100 without having to lift the container. Using the wheel assembly 158, a user can simply rest the container on the support surface 64 and guide it in the desired direction. The wheel assembly 158 is releasably attached through the container 100 to the front 34 and rear 36 fork support fixtures to allow the user to easily install and remove the wheel assembly 158 as desired.

The wheel assembly 158 consists of wheels 160 rotatably affixed at either end of a wheel axle member 162. Wheel axle member 162 is attached to a base plate 164. The attachment of axle member 162 and base plate 164 through the carton 100 to the front 34 or rear fork 36 support fixture is facilitated by cylindrical friction pegs 166 attached adjacent the midpoint of the axle member 162 and orthogonally positioned with respect to that axle member 162.

Figure 11:
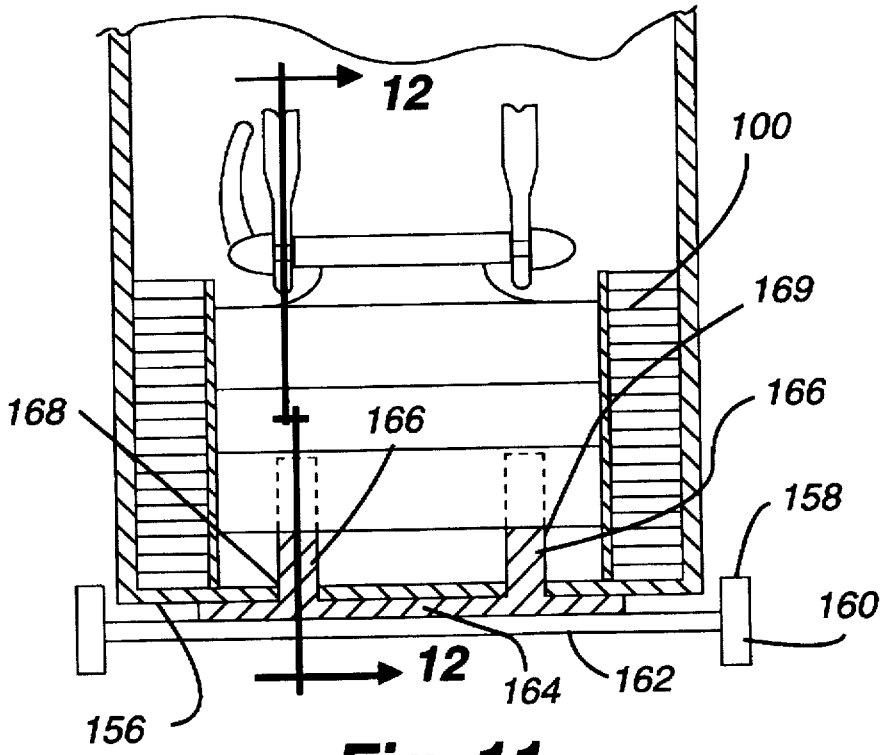
FIG. 11 is a partial section view similar to FIG. 10.
Figure 12:
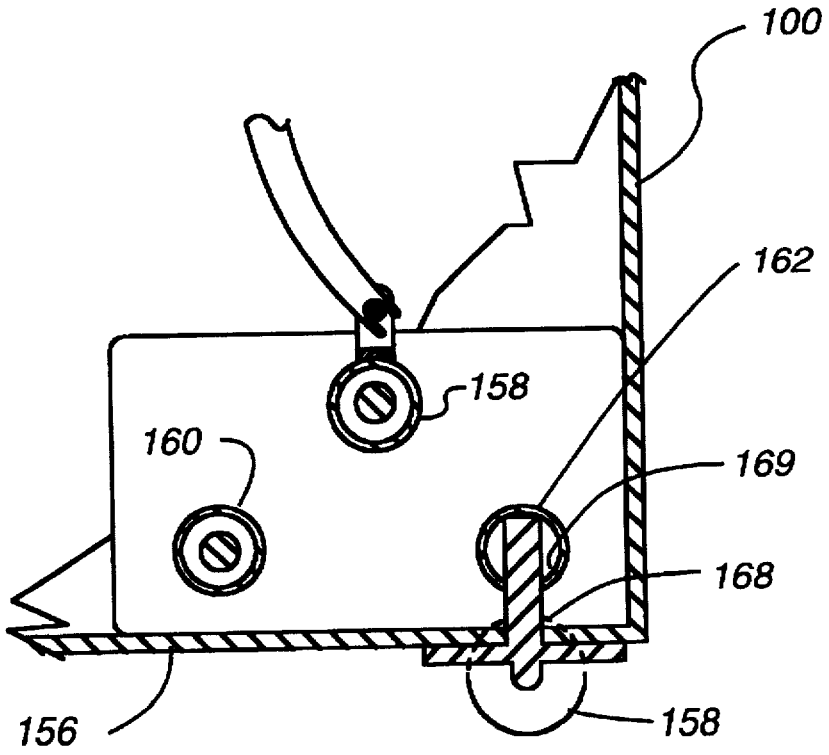
FIG. 12 is a section view taken along line 12—12 of FIG. 11.

As shown in FIGS. 11 and 12, wheel assembly 158 and specifically pegs 166, protrude through openings 168 defined by the floor 156 of carton 100 and extend upwardly into and through apertures 169 defined in the lower portion of any cross member, but preferably in the forwardly positioned lower cross member 62. The pegs 166 are inserted into the apertures 169 in the cross member 62 until the base plate 164 engages the floor 156 of the container 100. The apertures 169 formed in the cross member of either the front 34 or rear 36 fork support fixture are sized to create a friction fit between the pegs 166 and the cross member. The friction fit is important because it allows the wheel assembly 158 to be installed and removed easily, while being able to hold the wheel assembly on the container 100 when the container is lifted, such as to go down a flight of steps. The apertures 168' in the floor 156 of the container 100 must be coextensive to the apertures 168 in the cross member. The floor apertures 168' can be preformed in the container 100, or can be formed by the user in a standard container.

As discussed above, the container 100 can be transported on the wheel assembly 158 by having the wheel assembly 158 positioned under each of the front 134 and rear 136 fork support fixtures. Alternatively, the user can position the wheel assembly 158 under only one of the fork support fixtures. In this manner, by lifting an end of the carton 100, the container 100 can be rolled upon the wheel assembly 158. The wheel assembly 156 can be removed at any time and placed in the container 100, for instance when the container 100 is checked as luggage on an airplane, so that the wheel assembly 158 is not lost.

Figure 13:
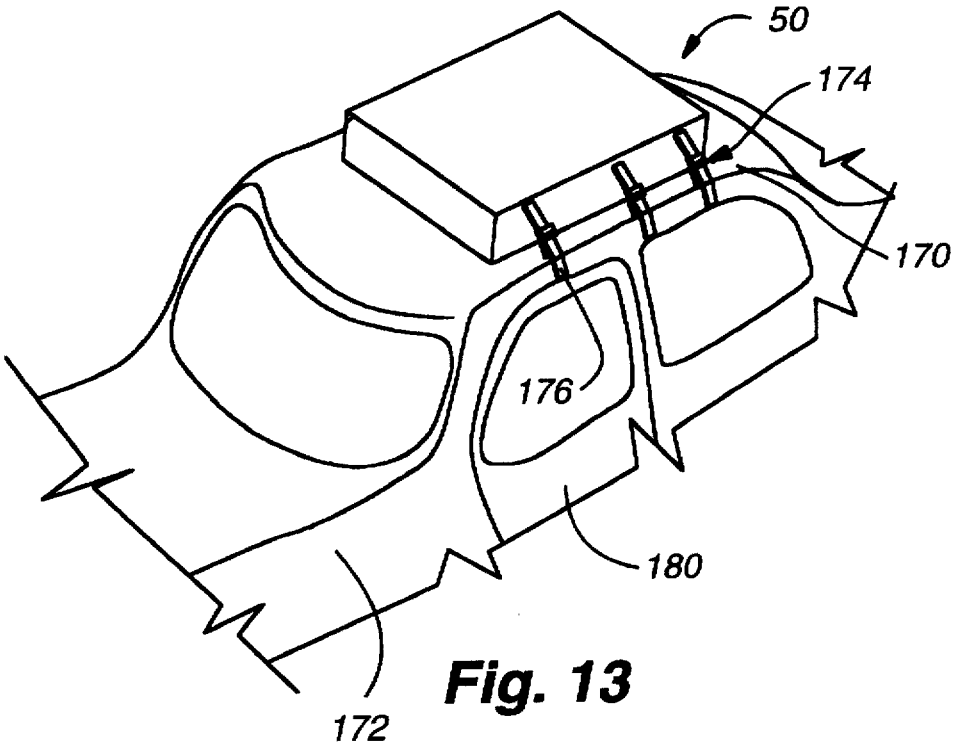
FIG. 13 is a perspective view of the bicycle packaging fixture assembly, including a container, attached to the roof of an automobile.
Figure 14:
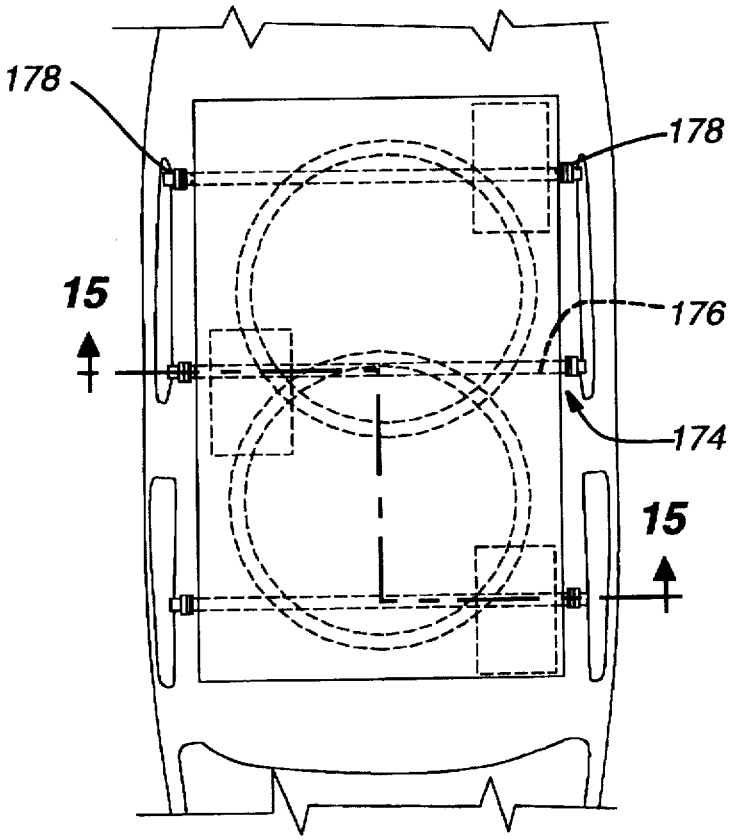
FIG. 14 is a schematic plan view of the fixture assembly as positioned on the roof of an automobile, illustrating the relative position of the fixtures and wheels inside the container.
Figure 15:
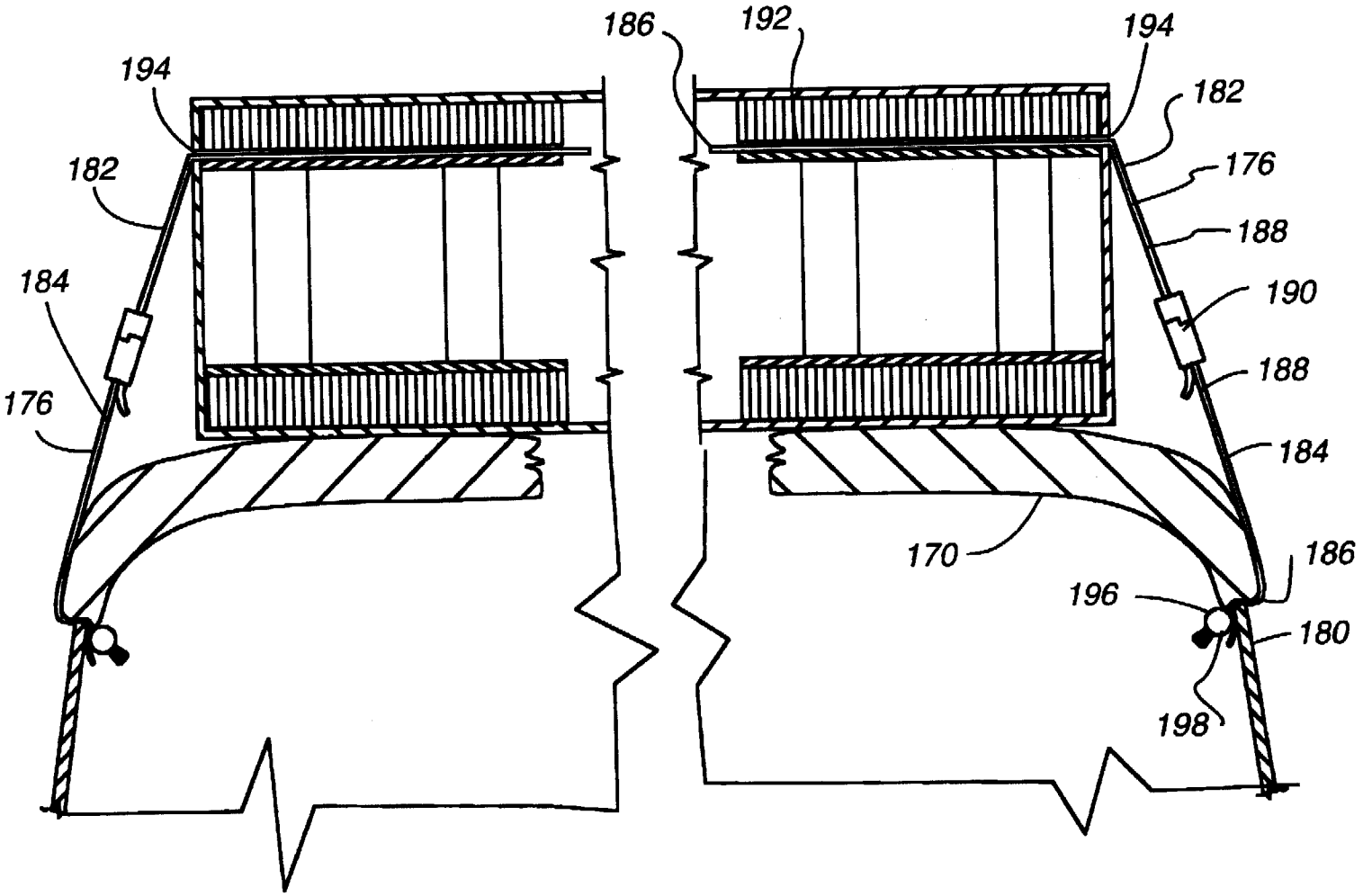
FIG. 15 is a section view taken along line 15—15 of FIG. 14.

The bicycle packaging fixture assembly 50 can be attached to the roof 170 of an automobile 172 without removing the bicycle from the container and attaching it to another bicycle carrying rack (not shown) on the automobile 172, as shown in FIGS. 13, 14, and 15. An automobile roof attachment 174 is provided to allow the container 100, containing the fixture assembly 50 holding the bicycle 30 to be safely and securely attached thereto. The roof attachment 174 is intended for use as a replacement for a separate car rack for short-duration use at relatively low speeds. The roof attachment 174 consists of three elongated flexible straps 176, each strap having opposing ends 178 secured between the closed car door 180 and the roof 170. Each strap passes through the container 100 and a fixture (front fork 34, rear fork 36, or top 48), and each strap 176 is adjustable in tension.

Each strap 176 is elongated and flexible, such as nylon webbing, and is divided into a longer portion 182 and a shorter portion 184. Each portion 182 and 184 has an outer end 186 and an inner end 188. The outer ends 186 are secured between the car door 180 and the roof 170, as described below. The inner ends 188 are attached to each other by a tension buckle 190, of any known type, with one variety, such as those used on back-pack straps, being shown in FIG. 15.

Each fixture (front fork 34, rear fork 44, or top 48) defines a slot 192 through the end members sized to receive the flexible strap 176. Appropriate slots 194 are formed in the container walls to allow the inner end 188 of longer portion 182 of each strap 176 to be threaded first into the container 100 through the slot 194 in the container wall, then through the slot 192 in the respective fixture, and then out of the container 100 through another slot 194 in the container wall. The inner end 188 of the longer portion 182 is then attached to the shorter portion 184 by connecting the mating halves of the tension buckle 190.

Figure 16:
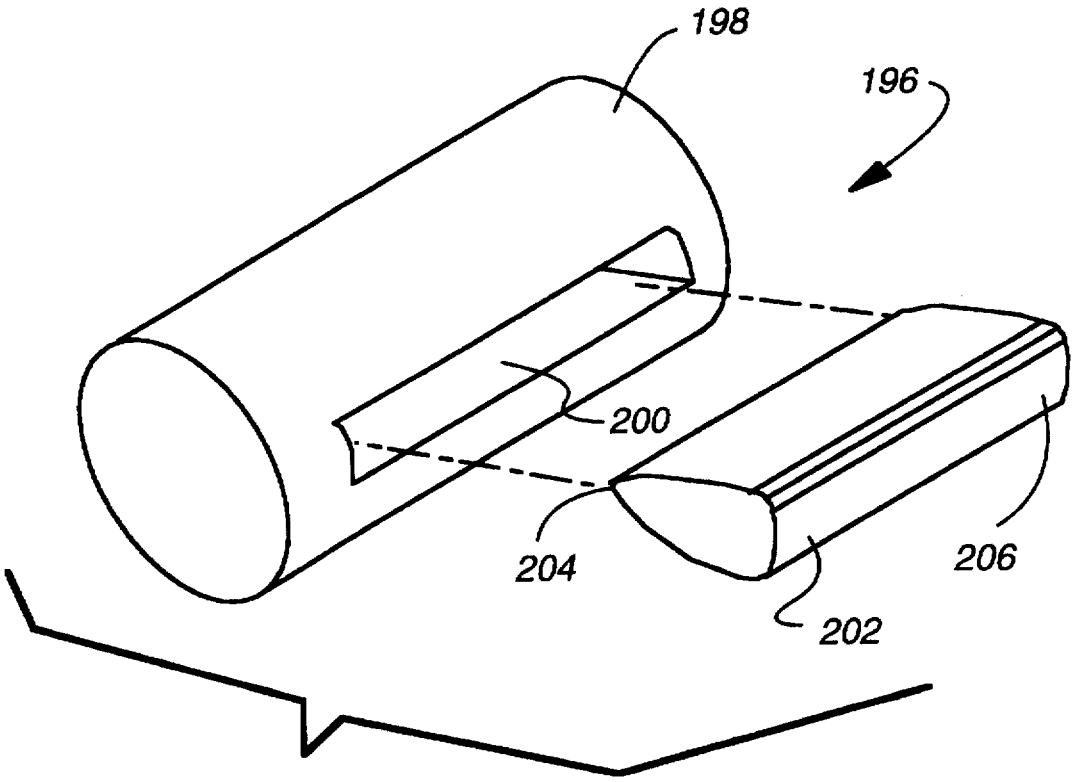
FIG. 16 is an exploded view of the strap end fixture.
Figure 17:
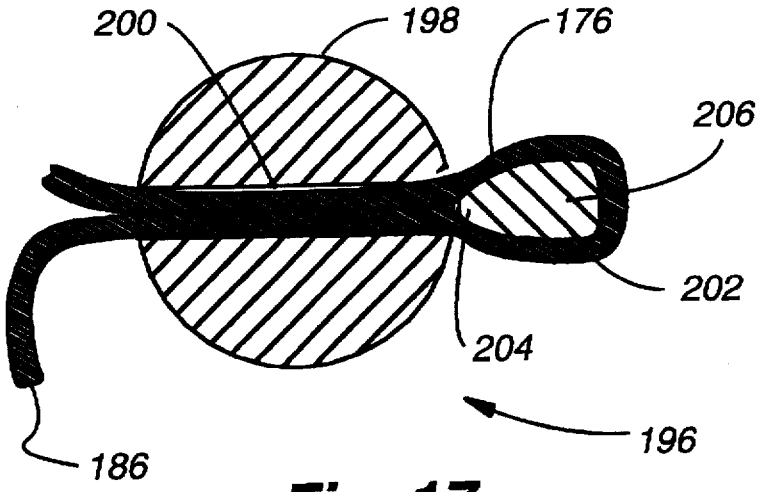
FIG. 17 is a representative section view of the strap end fixture, and illustrates the engagement of the strap with the strap end fixture.

The outer ends 186 of each strap 176 are held in place by a jam-fit strap end fixture 196, shown in FIGS. 15, 16, and 17. The strap end fixture 196 comprises a rigid cylindrical main body 198 longer than the strap 176 is wide, and defining a slot 200 therethrough formed along the diameter of the body 198. The slot 200 is dimensioned to receive at least two thicknesses of the strap 176 (FIG. 17). The strap end fixture 196 is attached to the strap 176 by threading the outer end 186 of the strap 176 through the slot 200, around a wedge-shaped member 202, and back through the slot 200. The wedge-shaped member 202 defines a narrow end 204 and a wide end 206. The strap 176 is pulled tight through the slot 200, forcing the narrow end 204 of the wedge-shaped member 202 into the slot 200, thus crimping the strap 176 between the sidewalls of the slot 200 and the wedge-shaped member 202. The strap 176 thus cannot then be pulled through the strap end fixture 196. The strap 176 can be removed from the strap end fixture 196 by pulling the narrow end 204 of the wedge-shaped member 202 from the slot 200, removing the wedge-shaped member 202, and then pulling the strap 176 back through the slot 202.

When the wedge-shaped member 202 is attached, as described above, to the strap-end fixture 196, the strap 176 can be closed between the door 180 and the roof 170 of the automobile 172 with the strap-end fixture 196 inside the automobile. The strap 176 can thus only be pulled out of the automobile until the strap-end fixture 196 engages the door 180 or roof 170 of the automobile, at which time it creates a jam-fit, against which the tensioning buckle 190 can be used to tighten the straps 176 through the container 100 to hold the container safely on the roof 170 of the automobile 172.

In short, after the longer portion 182 of each strap 176 is threaded through the container 100 and the respective fixtures, and attached to the associated shorter strap portion 184, the strap end fixtures 196 are positioned on the outer ends 186 of the straps, as described above, and shut inside the automobile between the door 180 and the roof 170. The strap 176 is then adjusted through the tension buckle 190 until the strap end fixture 196 engages the roof or door, and the container 100 is held firmly against the automobile roof 170.

Although the present invention has been described with a certain degree of particularity, it is understood that changes in detail or structure may be made without departing from the spirit of the invention as defined in the appended claims.

The invention claimed is:

1. Bicycle packaging fixture assembly for packing a bicycle in a cardboard shipping container, the bicycle having a frame, a front and rear wheel, the frame having a top-tube, and a pair of front and rear forks, the container having outer walls connected by end walls, a floor attached between lower portions of the outer and end walls, and an opening defined by upper portions of the outer and end walls, said assembly comprising:

a front support fixture having opposing outer end members spaced apart by and affixed to a cross member, the cross member defining a wheel seat, and a clamping device for releasably securing the front forks attached to said cross member;

a rear support fixture having opposing outer end members spaced apart by and affixed to a cross member, the cross member defining a wheel seat, and a clamping device for releasably securing the rear forks attached to said cross member;

a top support fixture having opposing outer end members spaced apart by and affixed to a wheel guide, the wheel guide defining a downwardly facing center groove and two downwardly facing outer grooves, and a releasable retention member associated with each of said grooves;

wherein said front forks are attached to the clamping device on said front fork support fixture, said rear forks are attached to the clamping device on said rear fork support fixture, said top-tube is positioned in said center groove and restrained therein by said retention member, said front wheel is positioned in said wheel seat in said front fork support fixture and attached thereto, and also positioned in one of said outer grooves in said top support fixture and attached thereto, said rear wheel engages said wheel seat in said rear fork support fixture and is attached thereto, and is also positioned in the other one of said outer grooves in said top support fixture and attached thereto, all forming a unitary assemblage; and said assemblage is positioned in said container such that said front and rear fork support fixtures engage said sidewalls, end walls and floor, and said top support fixture engages said sidewalls.

2. A stand as defined in claim 1, wherein a plurality of cross members are rigidly attached to and join said pair of opposing end members on both said front and rear support fixture.

3. A stand as defined in claim 2, wherein there are three cross members, each defining a longitudinal axis, and wherein said longitudinal axes are parallel to one another and form a triangular orientation.

4. A stand as defined in claim 1, wherein for said front and rear support members, said end members are planar and each comprise an inner rigid plate to which the cross member attaches, and an outer cushioning structure.

5. A stand for supporting a bicycle frame on a support surface, the frame having a pair of front forks and rear forks, said stand comprising;

a front fork support fixture having a clamping device, said clamping device adopted for releasably securing the pair of front forks;

a rear fork support fixture having a clamping device, said clamping device adopted for releasably securing the pair of rear forks; and said front and rear fork support fixtures each comprising:

a pair of opposing end members;

three cross members rigidly attached to and join said pair of opposing end members, said cross members each defining a longitudinal axis, and wherein said longitudinal axes are parallel to one another and form a triangular orientation, said plurality of cross members having an axis orthogonal to said end members, said cross members rigidly affixed to and joining said pair of opposing end members, said clamping device rigidly affixed to one of said cross members; and wherein said front and rear fixtures engage the support surface and support the frame thereupon.

6. A stand for supporting a bicycle frame on a support surface, the frame having a pair of front forks and rear forks, said stand comprising;

a front fork support fixture having a clamping device, said clamping device adopted for releasably securing the pair of front forks;

a rear fork support fixture having a clamping device, said clamping device adopted for releasably securing the pair of rear forks; and said front and rear fork support fixtures each comprising:

a pair of opposing end members, said end members being planar and each comprising an inner rigid plate to which the cross member attaches, and an outer cushioning structure;

a plurality of cross members rigidly attached to and join said pair of opposing end members, said plurality of cross members having an axis orthogonal to said end members, said plurality of cross members rigidly affixed to and joining said pair of opposing end members, said clamping device rigidly affixed to one of said plurality of cross members; and wherein said front and rear fixtures engage the support surface and support the frame thereupon.

7. A bicycle transport system, for shipping a bicycle having a front and rear wheel and a frame with a pair of front and rear forks, comprising;

a cardboard shipping container having a floor and four sides with flaps, said four sides defining a top opening for receiving a bicycle for shipment, and said flaps suitable for closing said top opening;

a front fixture having a clamping device and a base portion, said clamping device securing the front forks, and said base portion having opposing sides rigidly connected to said clamping device said opposing sides defining outer and lower surfaces for stabilizing the bicycle frame within said cardboard shipping container;

a rear fixture having a clamping device and a base portion, said clamping device securing the rear forks to the rear fixture and said base portion having opposing sides rigidly connected to said clamping device said sides defining outer and lower surfaces for stabilizing the bicycle frame within said cardboard shipping container;

said clamping device of said front fixture and said rear fixture being a quick-release; and a top support fixture having a wheel guide, and a base portion, said wheel guide having a lower surface defining three parallel grooves for receiving respectively said front wheel, said frame, and said rear wheel, and for securing the front and rear wheel to the frame of said bicycle and said base portion having opposing sides rigidly connected to said wheel guide, said opposing sides defining outer and upper surfaces for stabilizing the bicycle frame and wheels within the cardboard shipping container.

8. The bicycle transport system as defined in claim 7, further comprising;

a wheel assembly fixture removably affixed through said floor of said cardboard shipping container to attach to said front or said rear support fixture for rolling transport of said container.

9. A bicycle transport system for use on an automobile defining a roof, said system as defined in claim 7 further comprising:

a strap having opposing ends;

a slot formed through said container adjacent said top support fixture;

a slot formed through said end member of said top support fixture; and wherein said strap is threaded through said slot in said container and through said slot in said top fixture, and each opposing end of said strap is attached to said automobile to position said system on said roof.

* * * * *